US007584676B2

(12) United States Patent
Eichenberger et al.

(10) Patent No.: US 7,584,676 B2
(45) Date of Patent: Sep. 8, 2009

(54) REAR SERVICEABLE ENGINE STARTER

(75) Inventors: David Eichenberger, Sanford, NC (US); Darin Thorp, Montpelier, OH (US); Spencer Zeedyk, Bryan, OH (US); Steve Diacumakos, Apex, NC (US); Bill Piekarski, Dunellen, NJ (US); Jeremy Odell, Bryan, OH (US)

(73) Assignee: Ingersoll Rand Company, Montvale, NJ (US)

( * ) Notice: Subject to any disclaimer, the term of this patent is extended or adjusted under 35 U.S.C. 154(b) by 170 days.

(21) Appl. No.: 11/736,845

(22) Filed: Apr. 18, 2007

(65) Prior Publication Data

US 2008/0257295 A1 Oct. 23, 2008

(51) Int. Cl.
*F02N 1/00* (2006.01)

(52) U.S. Cl. ..... 74/6; 123/179.31

(58) Field of Classification Search ..... 74/6, 74/7 A, 7 E; 123/179.1, 179.31, 179.25
See application file for complete search history.

(56) References Cited

U.S. PATENT DOCUMENTS

| | | | | | |
|---|---|---|---|---|---|
| 1,598,820 | A | | 9/1926 | Hillmer | |
| 1,760,988 | A | | 6/1930 | Lansing | |
| 2,441,990 | A | | 5/1948 | Calhoun | |
| 3,010,443 | A | | 11/1961 | Lyvers | |
| 3,791,365 | A | | 2/1974 | Pharr et al. | |
| 4,080,541 | A | | 3/1978 | Mazzorana | |
| 4,126,113 | A | * | 11/1978 | Sarro et al. | 123/179.31 |
| 4,362,065 | A | | 12/1982 | Baratti | |
| 5,045,737 | A | | 9/1991 | Yamauchi | |
| 5,105,670 | A | | 4/1992 | Isozumi et al. | |
| 5,134,330 | A | | 7/1992 | Haas et al. | |
| 5,146,797 | A | | 9/1992 | Annovazzi et al. | |
| 5,163,335 | A | | 11/1992 | Isom et al. | |
| 5,281,115 | A | | 1/1994 | Timuska | |
| 5,329,896 | A | | 7/1994 | Everts | |
| 5,353,658 | A | * | 10/1994 | Nagashima et al. | 74/7 A |
| 5,767,585 | A | | 6/1998 | Shiga et al. | |
| 5,831,340 | A | | 11/1998 | Kobayashi et al. | |
| 5,834,852 | A | | 11/1998 | Katoh et al. | |
| 5,836,739 | A | | 11/1998 | Haramura et al. | |
| 5,847,471 | A | | 12/1998 | Morishita et al. | |
| 5,898,229 | A | * | 4/1999 | Murata et al. | 290/48 |
| 6,109,122 | A | * | 8/2000 | Bori et al. | 74/7 E |

(Continued)

FOREIGN PATENT DOCUMENTS

| | | | |
|---|---|---|---|
| JP | 4183242 | A | 6/1992 |

(Continued)

*Primary Examiner*—David M Fenstermacher
(74) *Attorney, Agent, or Firm*—Michael Best & Friedrich LLP

(57) ABSTRACT

A starter includes: a gear housing mounted near an engine to be started; a speed reducing gear assembly within the gear housing; an output member aligned with a movable portion of the engine and rotatable under the influence of the gear assembly to move the movable portion to initiate operation of the engine; a motor housing mounted to the gear housing; and a fluid-driven motor within the motor housing and including a motor shaft rotating at a first speed to drive rotation of the speed reducing gear assembly, such that the output member is driven at a second speed lower than the first speed. The motor housing and motor are serviceable without changing the alignment of the output member relative to the movable portion of the engine.

14 Claims, 3 Drawing Sheets

U.S. PATENT DOCUMENTS 6,166,448 A * 12/2000 Ando et al. ..... 290/38 R
6,559,566 B2 5/2003 Modi et al.
6,633,099 B2 10/2003 Fulton et al.
6,731,037 B1 5/2004 Kim et al.
6,817,258 B2 11/2004 Kajino et al.
6,834,630 B1 12/2004 Mueller et al.
6,930,430 B2 8/2005 Shiga et al.
6,969,235 B2 11/2005 Feest
2004/0237677 A1 12/2004 Inagaki

FOREIGN PATENT DOCUMENTS

JP 10089203 A 4/1998

* cited by examiner

REAR SERVICEABLE ENGINE STARTER

FIELD

The invention relates to starters for engines, and more particularly, to starters that are serviceable while mounted to the engine.

BACKGROUND

Internal combustion engines are typically provided with starter systems for initiating operation of the engine. Starter systems usually include an air motor driven by pressurized air and a gear system. Pressurized air is introduced to the air motor, causing a rotor to rotate. The rotor, which has a higher number of revolutions per minute (rpm) than what is needed to start the engine, is connected to the gear system, which includes one or more speed reducing gears configured to match the air motor rpm to the engine rpm. The reducing gears drive an output device such as a pinion, which is coupled to the engine. Rotation of the pinion cranks the engine, initiating operation of the engine.

SUMMARY

In one embodiment, the invention provides a starter comprising: a gear housing mounted near an engine to be started; a gear assembly within the gear housing; an output member aligned with a movable portion of the engine and rotatable under the influence of the gear assembly to move the movable portion to initiate operation of the engine; a motor housing mounted to the gear housing; and a fluid-driven motor within the motor housing and including a motor shaft driving rotation of the gear assembly; wherein the motor housing and motor are serviceable without changing the alignment of the output member relative to the movable portion of the engine.

In another embodiment, the invention provides a starter for moving a movable portion of an engine to start the engine. The starter comprises a gear housing having first and second opposite ends; a gear assembly within the gear housing and including a plurality of speed-reducing gears; an output member at the first end of the gear assembly aligned with the movable portion of the engine and adapted to operably couple to the movable portion of the engine; a motor housing having a first end mounted to the second end of the gear housing and a second end opposite the first end, the second end defining a service aperture; a motive fluid inlet adapted to permit a flow of motive fluid into the motor housing; a rotor rotatably mounted within the motor housing; and a motive fluid outlet mounted to the second end of the motor housing over the service aperture, and adapted to exhaust the motive fluid to a desired destination after the motive fluid has flown through the motor housing. The rotor rotates at a first speed in response to the flow of motive fluid through the housing. The speed-reducing gears rotate in response to rotation of the rotor. The output member rotates at a second speed slower than the first speed in response to rotation of the speed-reducing gears to cause the movable portion of the engine to move and start the engine. The motive fluid outlet is removable from the second end of the motor housing without changing the alignment of the output member relative to the engine. The rotor is removable from the motor housing through the service aperture after the motive fluid outlet has been removed and without disengaging the gear housing from the engine.

In another embodiment, the invention provides a method of servicing an engine starter that is engaged with an engine to be started. The engine starter has a gear housing mounted near the engine, a speed reducing gear assembly within the gear housing, an output member aligned with a movable portion of the engine and adapted to operably couple with the movable portion and rotatable under the influence of the gear assembly to move the movable portion to initiate operation of the engine, a motor housing mounted to the gear housing, a fluid-driven motor within the motor housing and including a motor shaft driving rotation of the speed reducing gear assembly to drive the output member, and a motive fluid outlet mounted over a service aperture of the motor housing and adapted to exhaust a motive fluid to a desired destination. The method comprises: removing the motive fluid outlet from the motor housing without changing the alignment of the output member relative to the engine; and then servicing the fluid-driven motor through the service aperture; and then installing the motive fluid outlet over the service aperture to resume operation of the engine starter.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
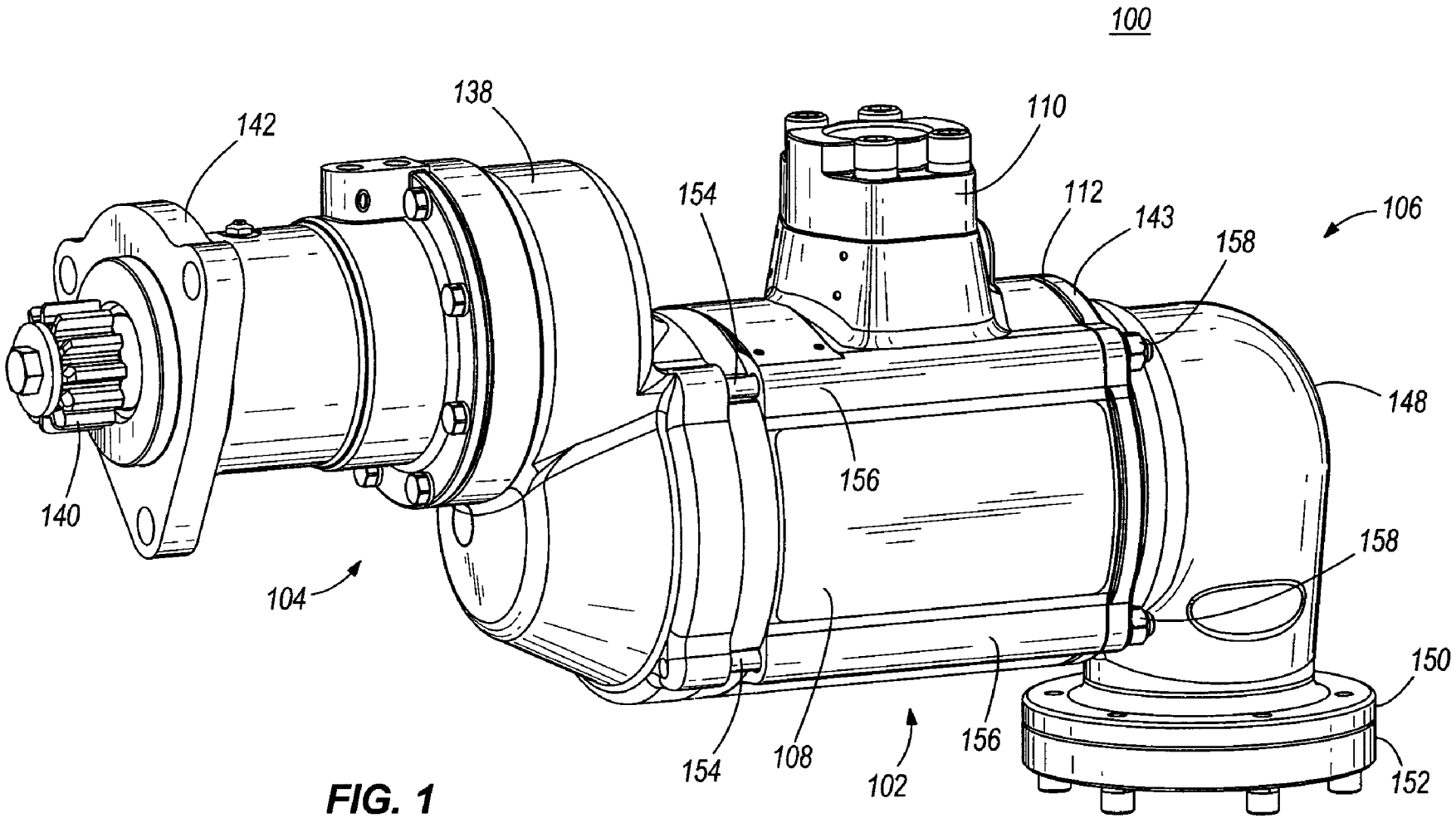
FIG. 1 is a perspective view of a starter system according to one embodiment of the invention.
Figure 2:
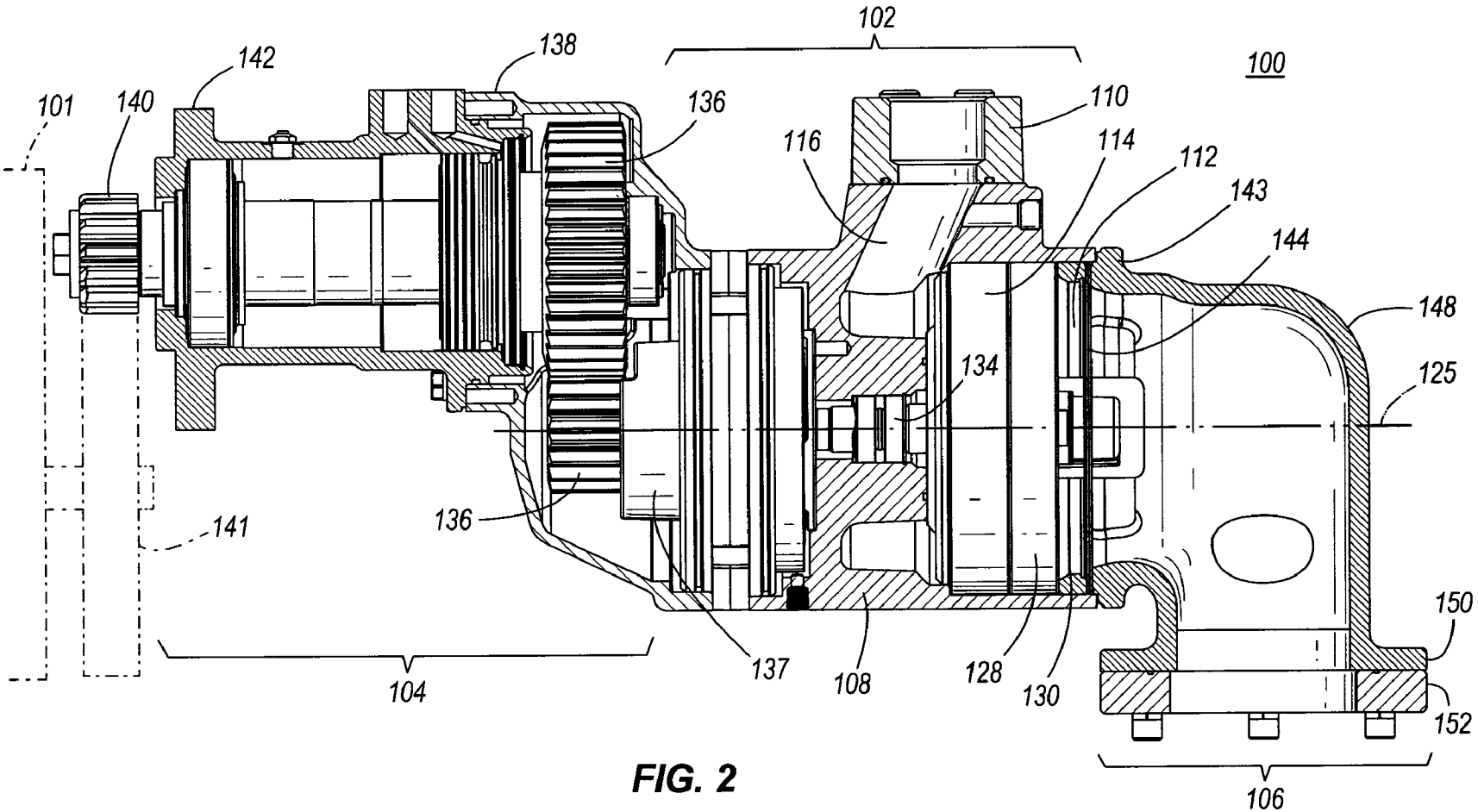
FIG. 2 is a cross-sectional view of the starter system of FIG. 1.
Figure 3:
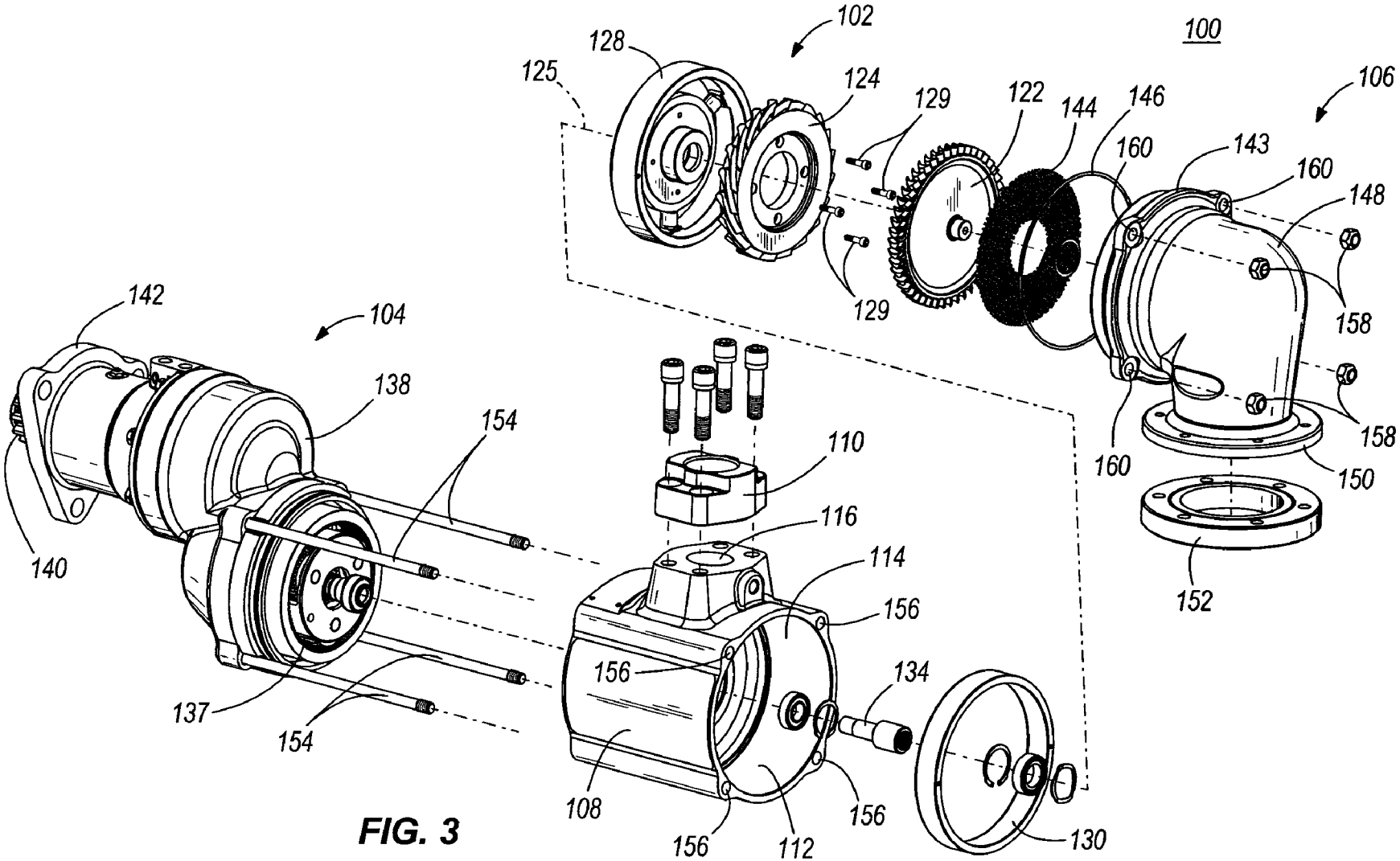
FIG. 3 is an exploded view of the starter system of FIG. 1.

FIGS. 1-3 illustrate a starter system 100 according to one embodiment of the invention. Starter system 100 can couple to an engine 101 (FIG. 2) for providing start-up cranking of the engine 101. Starter system 100 can be used with any type of engine, including but not limited to, internal combustion engines, diesel engines, and turbine and microturbine engines.

Starter system 100 can include an air motor module 102, a gear module 104 and motive fluid outlet 106. The gear module 104 is at the front of the starter system 100 oriented towards the engine 101 while the motive fluid outlet 106 is at the rear of the starter system 100 away from the engine 101. The air motor module 102 can include an air motor housing 108 with a motive fluid inlet 110 for receiving a motive fluid, such as pressurized air, into the air motor housing 108, and a service aperture 112 at one end of the housing 108. The air motor housing 108 can define an air motor chamber 114 in fluid communication with the motive fluid inlet 110 via a channel 116.

With reference to FIGS. 2 and 3, the air motor module 102 can further include a rotor 122, a stator 124, a stator housing 128 and a containment ring 130 arranged along the longitudinal axis 125. As shown in FIG. 3, the stator 124 can be secured to the containment ring 128 against rotation by way of fasteners 129. The stator 124 can direct the flow of motive fluid against the rotor 122 to cause rotation of the rotor 122 with respect to the stator 124. In one example, the motive fluid may be provided in the range of 30-150 psig, the stator 124 may act as a supersonic nozzle, and the rotor 122 may be designed to have a free turbine or "run away" speed of 65,000 rpm. The rotor 122 can be interconnected with the gear module 104 via, for example, an air motor shaft 134. The air motor shaft 134 is supported for rotation by bearings in the motor housing 108.

With reference again to FIG. 2, the gear module 104 can include one or more speed reducing gears 136 and a planetary gear 137 within a gear housing 138. Mounted at opposite ends of the reducing gears 136 and the planetary gear 137 are the air motor shaft 134 and an output member 140. The reducing gears 136 and the planetary gear 137 cause rotation of the output member 140 in response to rotation of the air motor shaft 134, while reducing speed and increasing torque of the output member 140 compared to the air motor shaft 134. In other embodiments, however, the reducing gears 136 and/or the planetary gear 137 may be excluded from the starter system 100. As shown in FIG. 2, the gear housing 136 is offset from the longitudinal axis 125 so that the output member 140 is offset from the longitudinal axis 125. In other embodiments, however, the gear housing 136 and/or the output member 140 is arranged along the longitudinal axis 125 as well.

The output member 140 can be, for example, a pinion. The output member 140 can interface (e.g., through direct meshing with a gear, or through a belt, a chain, a plurality of gears, or any other suitable means for transferring rotation and torque) with a movable portion, mechanism, or member 141 of the engine 101 and can be operable to move the movable portion 141 of the engine 101 in response to rotation of the reducing gears 136 in the gear housing 138. The movable portion 141 of the engine 101 may include, for example, a crankshaft, a gear or other torque transfer member, and other movable parts. The rotor 122 rotates at a first speed in response to the flow of motive fluid through the channel 116 and chamber 114 of the motor housing 108. The planetary gear 137 rotates in response to rotation of the rotor 122 and drives the speed-reducing gears 136. The output member 140 rotates at a second speed slower than the first speed in response to rotation of the speed-reducing gears 136 to cause the movable portion 141 of the engine 101 to move and start the engine 101.

In cases where the movable engine portion 141 is rotatable, the output member 140 can be said to transfer torque from the starter system 100 to the engine 101. This movement of the movable portion 141 of the engine 101 by the output member 140 can effectively start the engine 101. The gear housing 138 can include a flange 142 at an end opposite the air motor shaft 134. The flange 142 facilitates mounting the gear module 104 to the engine 101 or near the engine 101 to engage the output member 140 with the movable portion 141 of the engine 101.

The motive fluid outlet 106 can provide an exhaust system for the motive fluid from the starter system 100. The motive fluid outlet 106 can direct the flow of motive fluid out of the air motor housing 108 after the motive fluid has flown past the rotor 122. The motive fluid outlet 106 can include an exhaust cap 143 mounted to the air motor housing 108 over the service aperture 112. Thus, the output member 140 and mounting flange 142 are at a first end of the gear housing 138, a second end of the gear housing 138 (opposite the first end) is mounted to a first end of the motor housing 108, a second end of the motor housing 108 (opposite the first end) defines the service aperture 112 and has mounted thereon the exhaust cap 143.

A debris screen 144 can be positioned between the air motor housing 108 and the exhaust cap 143 for trapping debris. An O-ring seal 146 can also be positioned between the air motor housing 108 and the exhaust cap 143 to prevent motive fluid leakage. The exhaust cap 143, debris screen 144 and O-ring seal 146 can be arranged along the longitudinal axis 125 as well.

The motive fluid outlet 106 can further include a conduit 148 for directing exhaust motive fluid away from the starter system 100. The conduit 148 can be, for example, an elbow. The conduit 148 can include a pipe flange 150 for mounting the conduit 148 to a pipe coupling 152 to facilitate securing the conduit 148 to a pipe or other structure for directing the exhaust motive fluid to a remote location. The elbow version of the conduit 148 illustrated in the drawings may be employed in applications that use natural gas or another combustible gaseous fuel as the motive fluid, as for example, at a site that has a ready supply of such fuel for the engine 101 or another device. The pipe to which the conduit 148 is secured through the pipe coupling 152 may direct the natural gas or other combustible gaseous fuel to a flare or the combustion chamber of another device for immediate combustion, or may recapture the natural gas or other combustible gaseous fuel for future use.

In alternate embodiments of the motive fluid outlet 106, the conduit 148 may be replaced with a diffuser mounted to the exhaust cap 143. The diffuser would lower the pressure of the motive fluid prior to venting the motive fluid to the atmosphere or ambient surroundings. Such diffuser may be particularly useful in applications using compressed air as the motive fluid. The term "desired destination" is used herein to refer to the atmosphere, conduits, flares, combustion chambers, or any other destination for the motive fluid upon flowing out of the motive fluid outlet 106.

As shown in FIG. 3, four elongated fasteners 154 can extend from the gear housing 138. The fasteners 154 can be arranged parallel to the longitudinal axis 125. The air motor housing 108 can include four complementary passages 156 sized and shaped for receiving the fasteners 154. The fasteners 154, when received in the passages 156, can extend substantially the entire length of the air motor housing 108. Mating fasteners 158 can be placed over the fasteners 154 to secure the air motor module 102 to the gear module 104. The fasteners 154 and the mating fasteners 158 can be, for example, threaded fasteners such as bolts or studs and nuts.

The exhaust cap 143 can also include four passages 160 for receiving the fasteners 154 so as to mount the motive fluid outlet 106 to the air motor module 102. That is, the fasteners 154 can extend through the passages 156 and the passages 160 with the mating fasteners 158 placed over the fasteners 154 at the exhaust cap 143. Therefore, a single set of fasteners 154 can be used to mount the motive fluid outlet 106 and the air motor module 102 to the gear module 104. In this regard, the fasteners 154 extend through the motor housing 108 and secure the motor housing 108 to the gear housing 138 at one end of the motor housing 108, and secure the motive fluid outlet 106 to the motor housing 108 at an opposite end of the motor housing 108. In alternate embodiments, however, separate fasteners may be employed to mount the motive fluid outlet 106 to the air motor module 102.

Access to the air motor module 102 can be accomplished by removing the mating fasteners 158 from the fasteners 154. The exhaust cap 143 can be slid off of the fasteners 154 to remove the motive fluid outlet 106 from the air motor module 102, exposing the service aperture 112. Then, each internal component of the air motor module 102 can be slid out of the air motor housing 108 in turn. For example, the debris screen 144, the rotor 122, the stator 124, the stator housing 128 and the containment ring 130 can be removed from the air motor housing 108 through the service aperture 112. The air motor housing 108 can also be removed by sliding the air motor housing 108 off of the fasteners 154.

Alternately, the entire air motor module 102 can be removed with internal components substantially in their operative positions within the housing 108, by sliding the air motor housing 108 off of the four fasteners 154 with the internal components inside of the air motor housing 108. Alternately, the air motor module 102 may be serviced (e.g., cleaned or parts replaced) while still within the motor housing 108. As used herein, references to servicing the components of the starter "through the service aperture" include removing the components through the service aperture 112 prior to service, or leaving the components in the motor housing 108 while servicing the components.

Throughout the dismounting or disassembling process, the gear module 104, including the flange 142, the gear housing 138, the reducing gears 136 and the planetary gear 137, can remain in position aligned with the engine 101 through the flange 142. Likewise, throughout this process, the output member 140 can remain aligned with the movable portion 141 of the engine 101. This provides a substantial advantage in terms of the time required to service the air motor module 102 in the event foreign debris becomes entrained in the motive fluid and interferes with operation of the starter system 100 or occludes the screen 144 between scheduled maintenance. The present invention permits the rear portion of the starter 100 to be removed so the parts of the air motor module 102 can be cleaned, replaced, or otherwise serviced without affecting the relatively precise alignment of the output member 140 with respect to the movable portion 141 of the engine 101 and without having to disengage the output member 140 from the engine 101. As used herein, "disengage" means to operably decouple the output member 140 from the movable portion 141 of the engine 101 to the extent that the output member 140 cannot transmit sufficient torque or other force to the movable member 141 of the engine 101 to start the engine 101.

To re-assemble the starter system 100, the process is reversed. That is, the air motor housing 108 is installed on the gear module 104 by sliding the air motor housing 108 back over the fasteners 154. The internal components of the air motor module 102 can be assembled within the air motor chamber 108 prior to installing the air motor housing 108 on the gear module 104. Alternately, the internal components of the air motor module 102, including, for example, the rotor 122 and the stator 124, can be installed in the air motor housing 108 after the air motor housing 108 is slid onto the fasteners 154 by passing them through the service aperture 112. After the air motor module 102 is in place on the fasteners 154, the exhaust cap 143 is slid over the ends of the fasteners 154 to install or mount the motive fluid outlet 106 onto the air motor module 102. Finally, the mating fasteners 158 are secured to the fasteners 154.

The starter system 100 can be configured so that the motive fluid outlet 106 can be removed from the air motor module 102 to permit access to the service aperture 112 at the rear of the starter system 100 without removing the air motor module 102 from the gear module 104 and without changing the alignment of the gear module 104 relative to the engine 101. The starter system 100 can also be configured so that the internal components of the air motor module 102, including, for example, the rotor 122 and the stator 124, can be removed from the air motor housing 108 through the service aperture 112 while the motive fluid outlet 106 is removed without removing the air motor housing 108 from the gear module 104. Finally, the starter system 100 can also be configured so that the air motor housing 108 and/or the entire air motor module 102 can be removed from the gear module 104 without changing the alignment of the gear module 104 relative to the engine 101.

Thus, the invention provides, among other things, an engine starter that is serviceable without being removed or disengaged from the engine. Various features and advantages of the invention are set forth in the following claims.

What is claimed is:

1. A starter comprising:

a gear housing mounted near an engine to be started;

a gear within the gear housing;

an output member in alignment with a movable portion of the engine and rotatable under the influence of the gear to move the movable portion to initiate operation of the engine;

a motor housing mounted to the gear housing;

a fluid-driven motor within the motor housing and including a motor shaft driving rotation of the gear;

a motive fluid inlet adapted to deliver a motive fluid to drive rotation of the motor shaft;

a motive fluid outlet mounted to the motor housing and adapted to exhaust the motive fluid to a desired destination;

wherein the motor housing defines a service aperture;

wherein the fluid outlet is mounted to the motor housing over the service aperture;

wherein the motor may be serviced through the service aperture upon removal of the fluid outlet from the motor housing; and wherein the motor housing and motor are serviceable without changing the alignment of the output member relative to the movable portion of the engine.

2. The starter of claim 1, wherein the motor is serviceable without removing the motor housing from the gear housing.

3. The starter of claim 2, wherein the motor shaft rotates about an axis of rotation; the starter further comprising a plurality of fasteners extending parallel to the axis of rotation to secure the motor housing to the gear housing; wherein the motor housing is removed from the gear housing by moving at least one of the motor housing and plurality of fasteners parallel to the axis of rotation and off of the gear housing.

4. The starter of claim 1, further comprising a plurality of fasteners, each extending through portions of the gear housing, motor housing, and fluid outlet such that the motor housing and fluid outlet may be removed from the gear housing by moving the motor housing and fluid outlet off of the fasteners without changing the alignment of the output member relative to the movable portion of the engine.

5. The starter of claim 1, wherein the fluid-driven motor includes a stator and a rotor, wherein the motor housing includes a service aperture through which at least one of the stator and the rotor can be serviced without changing the alignment of the output member relative to the movable portion of the engine.

6. The starter of claim 1, wherein the gear housing is adapted to be mounted to a portion of the engine to be started.

7. The starter of claim 1, wherein the gear is a speed-reducing gear assembly, wherein the motor shaft rotates at a first speed; and wherein the output member rotates at a second speed lower than the first speed in response to the motor shaft driving rotation of the speed-reducing gear assembly and the speed-reducing gear assembly driving rotation of the output member.

8. A starter for moving a movable portion of an engine to start the engine, the starter comprising:

a gear housing having first and second opposite ends;

a gear assembly within the gear housing and including a plurality of speed-reducing gears;

an output member at the first end of the gear assembly aligned with the movable portion of the engine and adapted to operably couple to the movable portion of the engine;

a motor housing having a first end mounted to the second end of the gear housing and a second end opposite the first end, the second end defining a service aperture;

a motive fluid inlet adapted to permit a flow of motive fluid into the motor housing;

a rotor rotatably mounted within the motor housing; and a motive fluid outlet mounted to the second end of the motor housing over the service aperture, and adapted to exhaust the motive fluid to a desired destination after the motive fluid has flown through the motor housing;

wherein the rotor rotates at a first speed in response to the flow of motive fluid through the housing, the speed-reducing gears rotate in response to rotation of the rotor, and the output member rotates at a second speed slower than the first speed in response to rotation of the speed-reducing gears to cause the movable portion of the engine to move and start the engine;

wherein the motive fluid outlet is removable from the second end of the motor housing without changing the alignment of the output member relative to the engine; and wherein the rotor is removable from the motor housing through the service aperture after the motive fluid outlet has been removed and without disengaging the gear housing from the engine.

9. The starter of claim 8, wherein the gear housing is adapted to be mounted to an internal combustion engine.

10. The starter of claim 8, wherein the rotor rotates about an axis, the starter further comprising a plurality of fasteners extending parallel to the axis to secure the motor housing to the gear assembly.

11. The starter of claim 10, wherein each fastener extends through portions of each of the gear housing, motor housing, and outlet motive fluid outlet; and wherein the motor housing and motive fluid outlet may be removed from the gear housing by sliding the motor housing and motive fluid outlet off the fasteners while maintaining the fasteners secured to the gear housing.

12. A method of servicing an engine starter that is engaged with an engine to be started, the engine starter having: a gear housing mounted near the engine, a speed reducing gear assembly within the gear housing, an output member aligned with and operably coupled with a movable portion of the engine and rotatable under the influence of the gear assembly to move the movable portion to initiate operation of the engine, a motor housing mounted to the gear housing, a fluid-driven motor within the motor housing and including a motor shaft driving rotation of the speed reducing gear assembly to drive the output member, and a motive fluid outlet mounted over a service aperture of the motor housing and adapted to exhaust a motive fluid to a desired destination, the method comprising:

removing the motive fluid outlet from the motor housing without changing the alignment of the output member relative to the engine; and then servicing the fluid-driven motor through the service aperture; and then installing the motive fluid outlet over the service aperture to resume operation of the engine starter.

13. The method of claim 12, further comprising removing the motor housing from the gear housing without changing the alignment of the output member relative to the engine.

14. The method of claim 12, wherein the motor housing and motive fluid outlet are secured to the gear assembly by way of common fasteners; and wherein removing the motive fluid outlet from the motor housing includes sliding the motive fluid outlet off of the common fasteners while leaving the motor housing coupled to the gear assembly by the common fasteners.

* * * * *